United States Patent [19]

Gerhard et al.

[11] 4,230,971

[45] Oct. 28, 1980

[54] VARIABLE INTENSITY CONTROL APPARATUS FOR OPERATING A GAS DISCHARGE LAMP

[75] Inventors: Francis H. Gerhard, San Juan Capistrano; Gerald A. Felper, Anaheim, both of Calif.

[73] Assignee: Datapower, Inc., Santa Ana, Calif.

[21] Appl. No.: 940,435

[22] Filed: Sep. 7, 1978

Related U.S. Application Data

[63] Continuation-in-part of Ser. No. 865,209, Dec. 28, 1977, Pat. No. 4,168,453.

[51] Int. Cl.[3] ..... H05B 41/39

[52] U.S. Cl. ..... 315/307; 315/209 R; 315/283; 315/287; 315/290

[58] Field of Search ..... 315/208, 209 R, 224, 315/241 R, 283, 287, 290, 307, DIG. 5, DIG. 7

[56] References Cited

U.S. PATENT DOCUMENTS

| | | | |
|---|---|---|---|
| 3,890,537 | 6/1975 | Park et al. | 315/287 X |
| 3,906,302 | 9/1975 | Wisjboom | 315/209 R |
| 3,913,002 | 10/1975 | Steigerwald et al. | 315/224 X |
| 4,004,187 | 1/1977 | Walker | 315/DIG. 5 |
| 4,017,785 | 4/1977 | Perper | 315/221 X |
| 4,042,856 | 8/1977 | Steigerwald | 315/208 X |

*Primary Examiner*—Eugene R. LaRoche

*Attorney, Agent, or Firm*—Knobbe, Martens, Olson, Hubbard & Bear

[57] ABSTRACT

A gas discharge lamp is connected in parallel with an inductor and in series with a solid state switching device and a resistor, and this combination is connected across a rectified AC voltage source. This switching device is controlled by a monostable multivibrator, the input of which is connected to the output of a comparator amplifier sensing the difference between the voltage drop across the above-mentioned resistor and a voltage which bears a predetermined relationship to the rectified AC signal of said source. This results in a high frequency operation of the lamp wherein the lamp current level is controlled or modulated in accordance with the rectified AC supply voltage, providing a high power factor lamp circuit without the normal heavy lamp ballast. In addition, a circuit is disclosed which prohibits the lamp from exhibiting a high resistance when the AC voltage is at a zero crossing point, protecting the solid state switching device and stabilizing the high frequency.

18 Claims, 14 Drawing Figures

Fig. 1
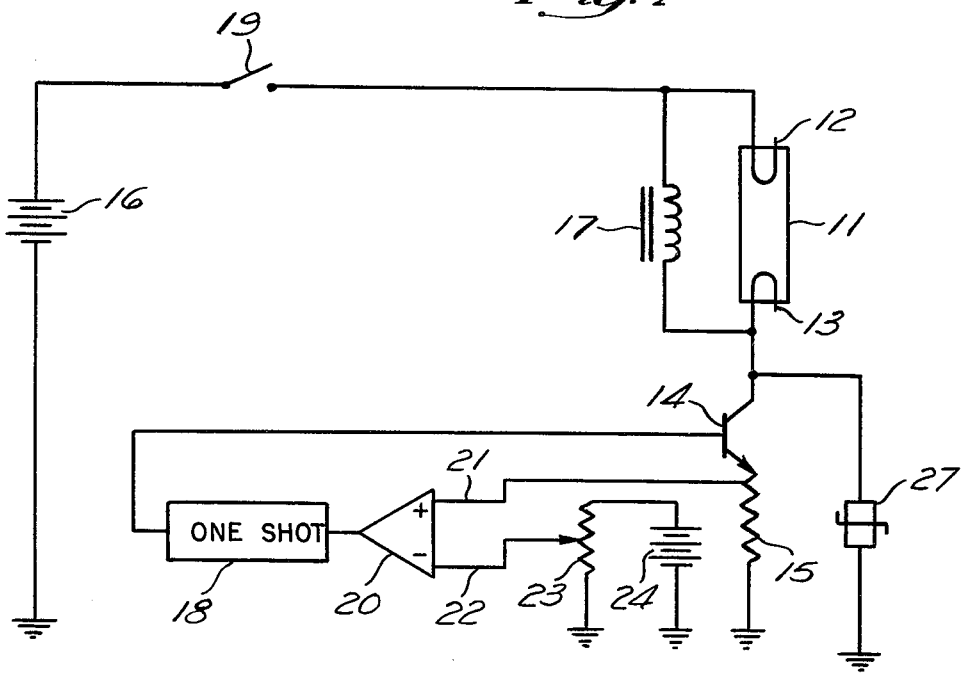
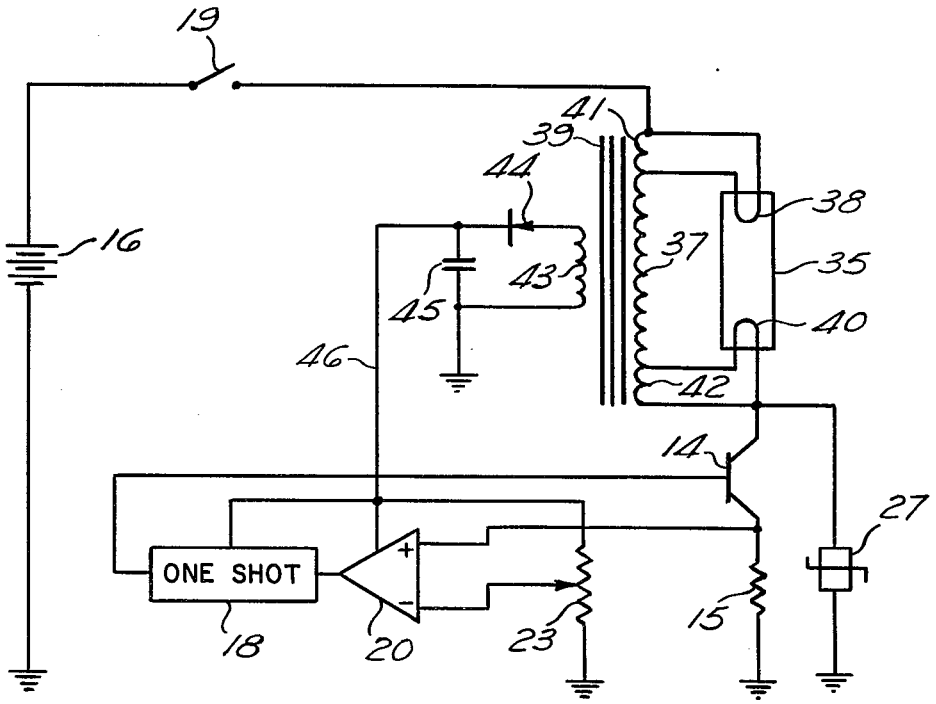
Fig. 3

Fig. 7
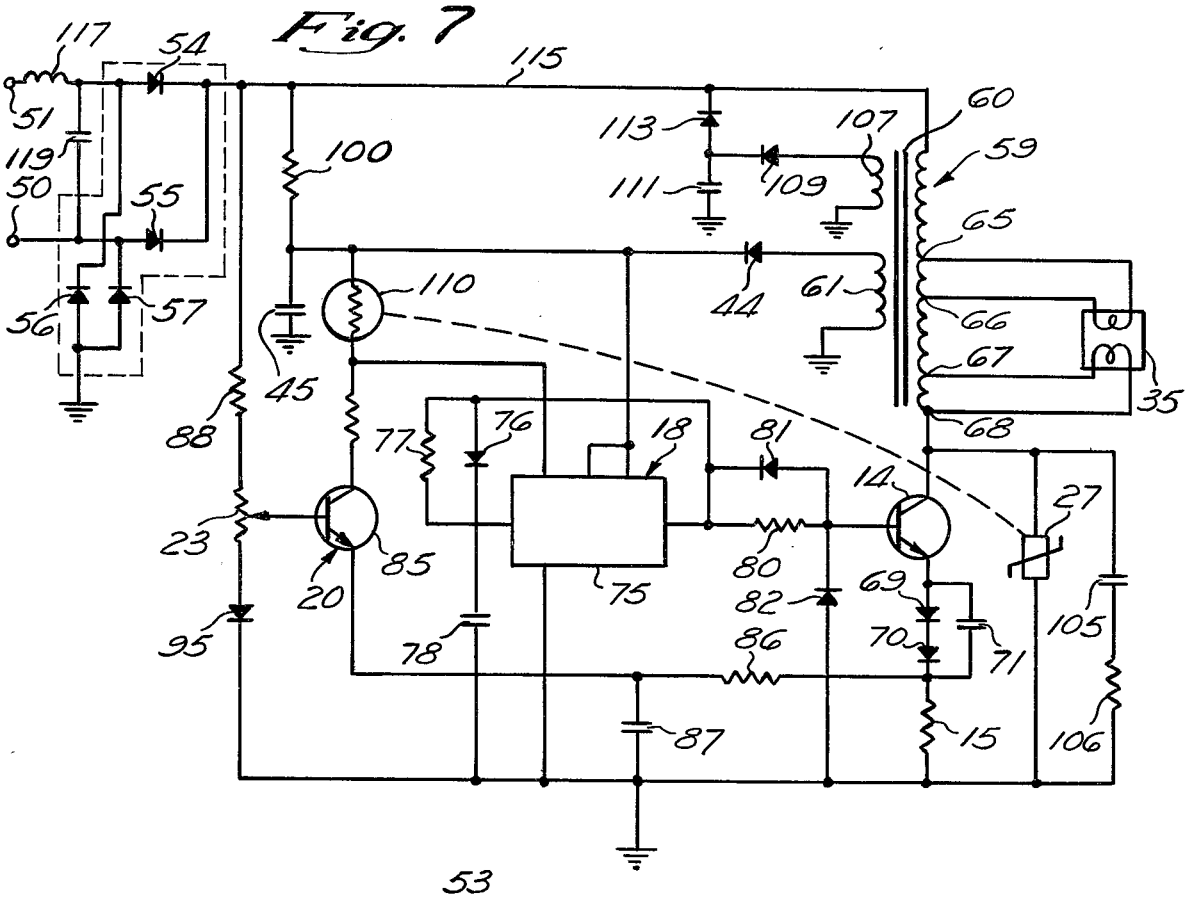
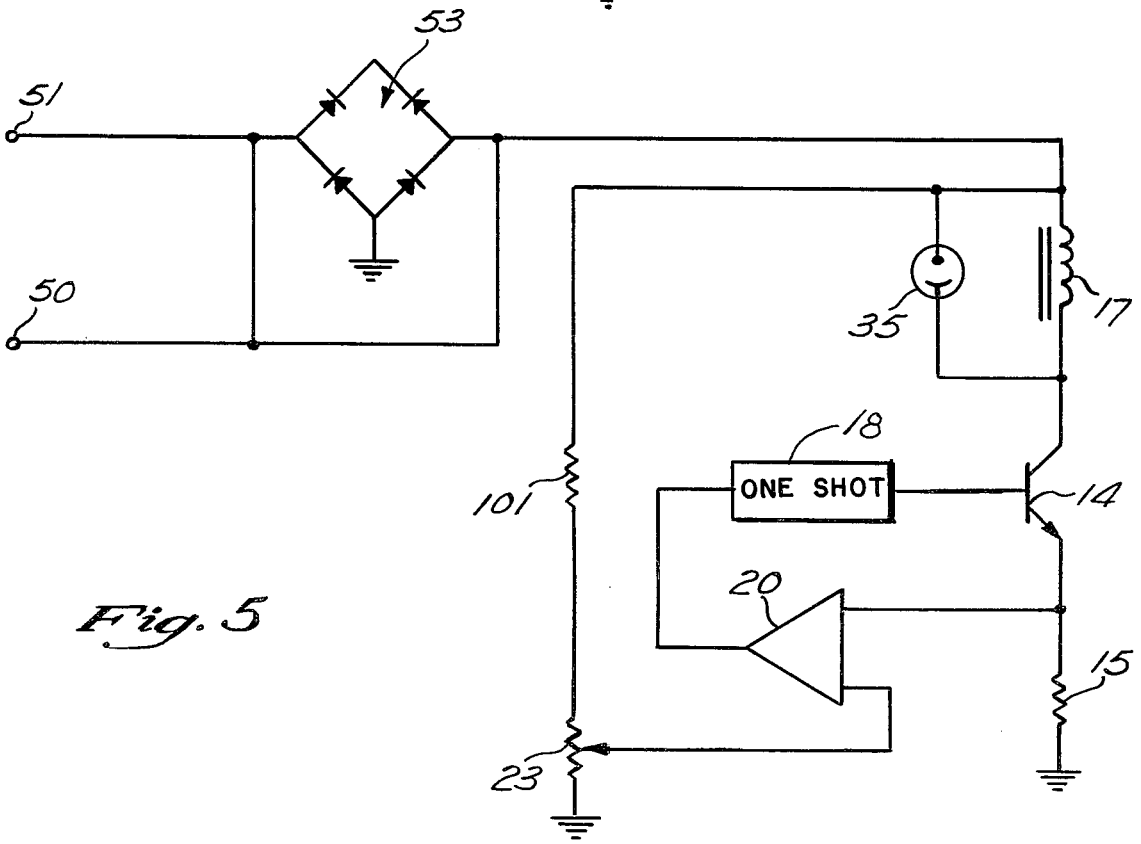
Fig. 5

VARIABLE INTENSITY CONTROL APPARATUS FOR OPERATING A GAS DISCHARGE LAMP

RELATED APPLICATION

This is a continuation-in-part of our co-pending application, Ser. No. 865,209, filed Dec. 28, 1977, now U.S. Pat. No. 4,168,453, issued Sept. 18, 1979.

BACKGROUND OF THE INVENTION

1. Field of the Invention

This invention relates to apparatus for operating a gas discharge lamp, such as a fluorescent, a mercury vapor lamp, a sodium lamp, or a metal halide lamp.

2. Description of the Prior Art

Control circuits for gas discharge lamps are known which obviate the need for the usual heavy and expensive series ballast devices, corresponding to the inductor in this device. In such circuits, switching elements are provided to periodically switch the direction of current through the lamp to reduce the deterioration or errosion of electrodes, and to ensure a high enough frequency of switching to reduce the requirement for the size of the ballast. Such circuits generally require two switching elements for each direction of the current.

Attempts have been made to fabricate the same type of circuit using only a single switching element to cause current reversal on the lamp. For example, the U.S. Pat. No. 3,906,302, to D. B. Wijsboom, is directed to such an arrangement and incorporates an inductor in parallel with the lamp, which lamp is in series with a switching device. Such a switching device is generally operated at relatively high frequencies, such as 20 kHz. A significant disadvantage of this prior art device is that its control circuitry does not provide for varying the intensity of the lamp.

Such prior art circuits typically operate from a DC source, either from batteries or from a rectified and filtered AC source. In the latter instance, the filtering required results in a poor power factor, making the circuits unacceptable in certain applications.

SUMMARY OF THE INVENTION

A gas discharge lamp and an inductor or choke coil are connected in parallel with one another. One side is connected to a rectified, but substantially unfiltered (at the power frequency) power source and the other side is connected to the collector of a transistor switch. The emitter of the transistor is connected to one end of a resistor, and the other end of the resistor is connected to the AC power supply return. The base of the transistor is connected to the output of a monostable or one-shot multivibrator. The input to the one-shot multivibrator is connected to the output of a comparator amplifier. The multivibrator operates in such a way that when the input to the multivibrator is high, the multivibrator is triggered and its output goes low for a predetermined amount of time, after which its output returns to the high state. The two inputs to the comparator amplifier are connected in such a way that one input is connected to the emitter of the transistor and the other input is connected to the AC power supply. The circuit components and the time delay of the multivibrator are chosen in such a way as to provide a relatively high rate of switching on the base of the transistor, approximately 20 to 40 kHz.

The alternating current flowing through the gas discharge lamp has no direct current component. As a result, the useful life of the lamp is increased by maximizing the life of the electrodes since a direct current component of lamp current causes excessive cathodic heating of one of the two electrodes and reduces the life of that electrode.

A significant feature of this invention is that the current of the lamp is varied precisely in relation to the AC line voltage, so that the power factor of the circuit is high.

A further aspect of this invention features the use of a secondary winding on the lamp ballast which, through a diode, charges a capacitor. This capacitor is isolated from the rectified AC power line by a diode. When the AC power voltage crosses zero volts, that is, when the rectified AC voltage is near its null point, the isolation diode becomes forward biased, and the charge on the capacitor prohibits the rectified AC voltage from nulling.

Because a gas discharge lamp increases in resistance at a power voltage null, the capacitor used to prohibit nulling avoids this high resistance load characteristic, and thus protects the solid state switching device.

In one embodiment of this invention, a low voltage power supply suitable for powering the one-shot multivibrator and comparator amplifier may be supplied by a second step-down transformer having as its primary winding the choke coil connected in parallel with the gas discharge lamp.

BRIEF DESCRIPTION OF THE DRAWINGS

The invention will be described in detail with reference to the accompanying drawings in which:

FIG. 1 illustrates an embodiment of a control circuit for a gas discharge lamp shown in simplified form for facilitating an understanding of the overall function of the control apparatus;

FIG. 2 shows four waveform plots labeled 2A, 2B, 2C, and 2D which are characteristic of the control circuit illustrated in FIG. 1.

FIG. 3 illustrates another modified form of the invention in which the choke or inductor windings are used as the primary windings of a step-down transformer which supplies power for the one-shot multivibrator and the comparator amplifier as well as the reference voltage to the input of the comparator amplifier. FIG. 3 also illustrates the use of the primary coil as an auto transformer to supply current to the electrodes of the gas discharge lamp as a source of preheating current prior to ignition of the lamp;

FIG. 5 illustrates another modified form of the invention in which the reference voltage for the comparator circuit is derived directly from the output of a bridge which supplies the circuit with rectified AC power;

FIG. 6 shows two waveform plots labeled 6A and 6B, which are characteristic of the control circuit illustrated in FIG. 5.

FIG. 7 illustrates a modified form of the circuit of FIG. 4 in which a capacitor is charged by a secondary winding on the lamp ballast and is utilized to prohibit the output of the rectifying bridge from reaching a null so that the lamp will not exhibit high resistance characteristics;

FIG. 8 shows three waveform plots labeled 8A, 8B, and 8C, which are characteristic of the control circuit illustrated in FIG. 7.

DESCRIPTION OF THE PREFERRED EMBODIMENT

Figure 2A:
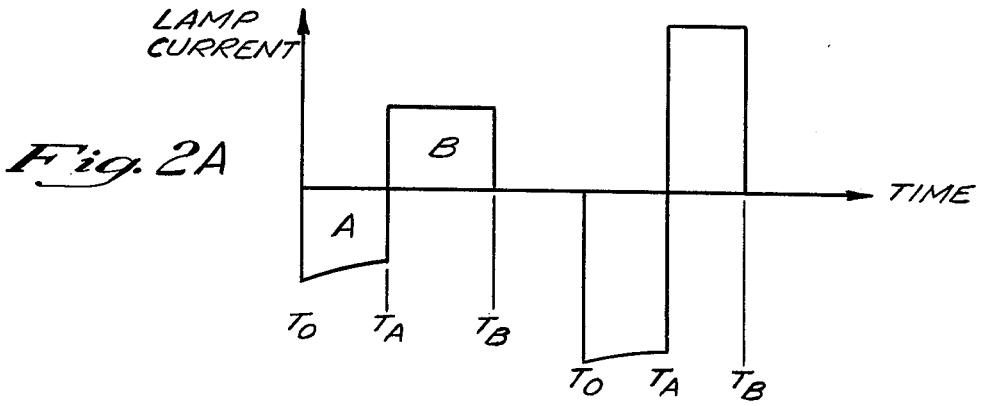
FIG. 2A is a plot of the current through the gas discharge lamp as a function of time.

Referring to the circuit illustrated in FIG. 1, a gas discharge lamp 11, typically a low-pressure mercury vapor fluorescent lamp, having two electrodes 12 and 13, has its electrode 13 connected to an electronic switch shown as an NPN transistor 14, the collector of which is connected to electrode 13, and the emitter connected to a resistor 15. The other end of the resistor 15 is connected to ground. The other electrode of the gas discharge tube 12 is connected to a DC power supply. This supply will normally be a rectified AC source but is shown for simplicity in this figure as a battery 16 whose positive terminal is connected through on-off switch 19 to electrode 12 and whose negative terminal is connected to ground. A choke or inductor 17 is connected in parallel with the electrodes of the gas discharge lamp 12 and 13.

The base of the NPN transistor switch 14 is connected to the output of a one-shot multivibrator 18. The monostable multivibrator operates in such a way that when the input to the multivibrator is low its output is high, and when its input is high, the monostable multivibrator is triggered such that its output goes into the low state for a predetermined finite length of time, after which the output of the multivibrator returns to the high state. The input of the multivibrator is connected to the output of a comparator amplifier 20. The positive input of the comparator amplifier is connected through a conductor 21 to the emitter of the NPN transistor 14, and the negative input of the comparator amplifier is connected through a conductor 22 to a potentiometer 23. Potentiometer 23 is connected to the positive end of a DC power source 24, and the negative end of the DC power source 24 is connected to ground.

The operation of the circuit of FIG. 1 is as follows. When the switch 19 is first closed, the current passes through the switch 19 and through the inductor 17. No current passes through the gas discharge lamp 11 because, until it is ignited by high voltage, the lamp remains nonconductive. The current through the inductor passes through the NPN transistor switch 14 and through the resistor 15 to ground. The current through the inductor 17 rises as a function of time until it reaches a level at which the voltage drop across the resistor 15 exceeds the voltage on the conductor 22. The voltage on the conductor 22 is determined by the potentiometer 23. When the voltage drop across the resistor 15 exceeds the voltage on the conductor 22, the comparator amplifier 20 senses a positive difference between its inputs and the output of the comparator amplifier 20 changes from the low to the high state. In response to the high output of the comparator amplifier 20, the one-shot multivibrator 18, is triggered and provides a low output for a short predetermined length of time. Thus, the transistor switch 14 will be turned off for the short period of time during which the base of the transistor receives a low level signal from the multivibrator 18. The magnetic field in the choke 17 then collapses, resulting in a voltage potential across the electrodes 12 and 13 of the gas discharge lamp 11. This potential is sufficient to ignite the lamp and the lamp begins to conduct current.

After the above-mentioned short predetermined length of time, the one-shot multivibrator output returns to its normally high level state, thereby turning the transistor switch 14 back on. At this instant in time, current begins to flow from the source 16 through the electrodes 12 and 13 of the gas discharge lamp 11 in the opposite direction to the current supplied before by the choke 17. The magnetic field in the choke 17 also begins to build up again as does the current through the choke 17. This results in a rise in the collector current of the transistor 14 and an equal rise in current through the resistor 15. This rise in current will cause the voltage drop across resistor 15 to rise until the conductor 21 again exceeds the voltage on conductor 22. Again, the comparator amplifier 20 will give a high output when this condition is reached, causing the output of the multivibrator 18 to go into the low state for the finite period of time thereby turning off the collector current of the transistor 14. The magnetic field in the choke 17 will collapse at this time, thereby causing a current to flow between the electrodes 12 and 13 of the gas discharge lamp 11 in a direction opposite to the direction traveled by the current when the transistor 14 was on. This condition will continue until the multivibrator output returns automatically to the high state.

As may be seen from this description, this process will continue to repeat itself as the transistor 14 continuously is switched on and off until steady state conditions are achieved. One or more cycles of operation may be required to ionize the lamp and cause it to ignite.

A varistor or high voltage zener diode 27 is connected between the collector of the NPN transistor and ground, and serves to protect the transistor 14 from destructive breakdown in the event of lamp failure causing an open circuit between its terminals, or inadvertent unplugging of the lamp when the power switch 19 is closed. When the lamp itself is defective and causes an open circuit or when the lamp is removed, the voltage rise at the collector of transistor 14 produced by collapse of the magnetic field in the inductor 17 will be limited to the breakdown voltage of the varistor, a value selected to be within the safe limits of the collector-base junction of the transistor switch 14.

A significant feature of the invention is that the varistor 27 serves the additional function of preventing ignition of the lamp until the lamp electrodes have been warmed up over a time period which is long compared to the operating period of the control circuit. Thus, the control circuits of this invention, without the varistor, would typically supply on the order of 1000 volts across the lamp in the fly back mode. Such high voltage applied to the lamp filaments when they are cold would be extremely deleterious since the electrodes would undergo a very high rate of change of temperature. The varistor is selected such that it breaks down for voltages exceeding 500 to 600 volts. At these lower voltages, the lamp 11 will not ignite until after the cathodes have been heated. Typically, a time delay of ¾ second to one second is the amount of time needed to heat up the cathodes sufficiently for the lamp to ignite when supplied with 500 to 600 volts.

FIGS. 2A, 2B, 2C, and 2D are plots of the steady state response characteristics of the circuit for two different levels of input power to the gas discharge lamp.

FIG. 2A is a plot of a single cycle of current through the gas discharge lamp as a function of time. The current is plotted on the vertical axis and the time is plotted on the horizontal axis. It will be understood that the current alternates through the lamp in a repetitive cycle. In the region of FIG. 2A, denoted "A", the transistor switch 14 is in the off state and the collapsing field in the inductor 17 is forcing a current through the gas discharge lamp. The region A covers a period of time between time $T_O$ and time $T_A$. This time period is equal to the unstable period of multivibrator 18. In the region in FIG. 2A denoted "B", the transistor switch 14 is on. The region B lies between the time $T_A$ and the time $T_B$, after which the cycle repeats itself.

In FIG. 2A, the magnitude of the lamp current in region A is shown to be roughly equal to the magnitude of the current in region B. Since, for reasons described above, there is no net DC current through the lamp, the respective areas under the curves in regions A and B are equal. Thus, in the circuit operating mode illustrated by FIG. 2A, the duration of the time periods A and B are roughly equal. The operational mode shown in FIG. 2A having approximately equal current flows in regions A and B is advantageous since it maximizes the efficiency of the lamp and also minimizes the current handling requirements for the switch transistor 14. This operating mode is achieved for a fairly narrow range of DC voltage output of the power source 16 for a given lamp. The circuit of FIG. 4 described below provides a means for matching a given DC voltage to a plurality of lamp or lamps having different optimum voltages.

Figure 2B:
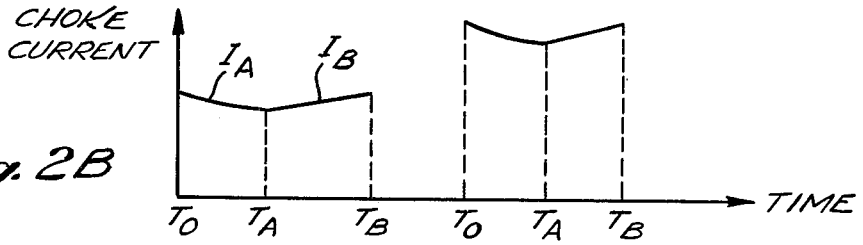
FIG. 2B is a plot of the current through the choke or inductor as a function of time.

FIG. 2B is a plot of the current through the choke or inductor 17 as a function of time. The current through the choke is plotted on the vertical axis, while time is plotted on the horizontal axis. In the region of FIG. 2B denoted "A", at time $T_O$, the transistor has been turned off and the current through the choke is decaying as a function of time until time $T_A$. At time $T_A$, the transistor is turned on. The current through the choke in the region of FIG. 2B denoted "B" increases until time $T_B$, at which time the transistor is turned back off, and the cycle repeats itself. The behavior of the circuit thus alternates between the behavior plotted in region A and the behavior plotted in region B.

Figure 2C:
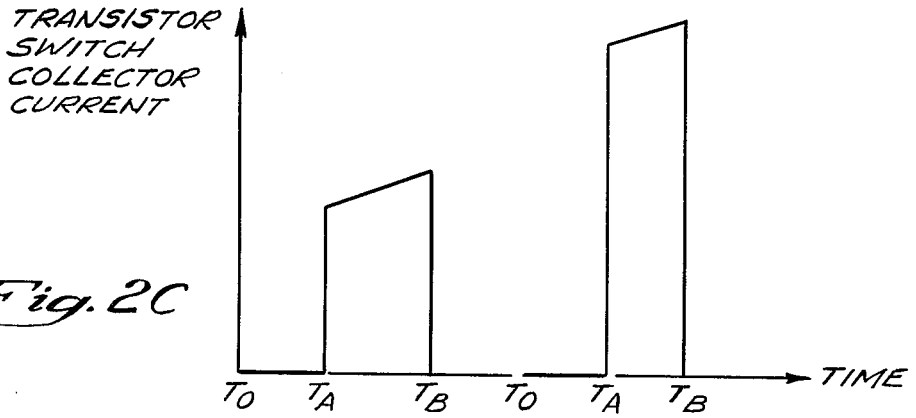
FIG. 2C is a plot of the collector current of the transistor as a function of time.

FIG. 2C is the plot of the collector current of the transistor plotted as a function of time. The collector current amplitude is plotted on the vertical axis and time is plotted on the horizontal axis. In the region denoted A of FIG. 2C, the transistor is off and therefore the collector current remains zero, from time $T_O$ to the end of region A at time $T_A$. In the region denoted B in FIG. 2C, at time $T_A$, the transistor is turned on and remains on until time $T_B$, which defines the end of region B. During this time, the collector current continually increases. At time $T_B$ the transistor is again turned off and the process repeats itself. Thus, the collector current is periodic in time. The current level indicated by the plot is equal to the voltage on the conductor 21 of FIG. 1 divided by the resistance of the resistor 15 in FIG. 1.

Figure 2D:
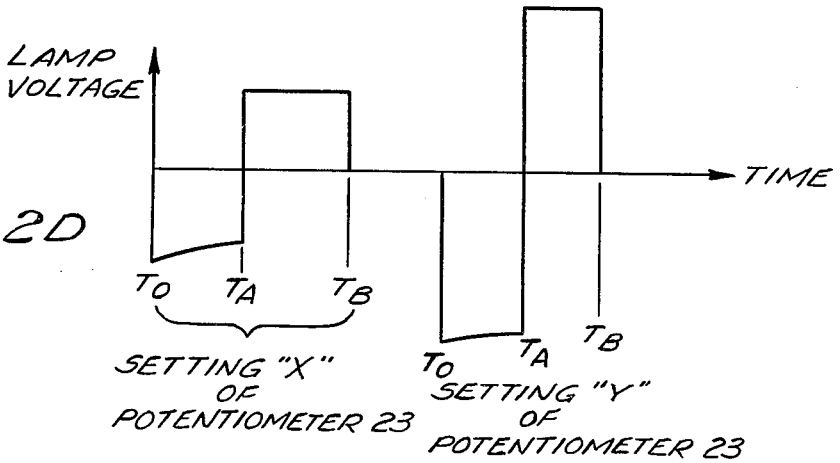
FIG. 2D is a plot of the voltage across the gas discharge lamp as a function of time. In all of these plots, time is plotted on the horizontal axis and the voltage or current is plotted on the vertical axis.

FIG. 2D is a plot of the voltage across the gas discharge lamp as a function of time. It is identical in shape to the lamp current shown in FIG. 2A at the operating frequency of the circuit, i.e., the frequency at which the transistor switch 14 is switched on and off. This frequency is chosen so that its period is short compared to the ionization time of the lamp. A representative operating range is from between 20 to 40 kHz. At this high frequency, the lamp appears electrically to be a resistor. Since the current through a resistor is linearly proportioned to the voltage across it, the lamp voltage and current waveforms are identical in shape.

This high frequency operation has the significant advantage that the weight of the choke, shown in FIG. 1 as 17, may be considerably reduced below the weight of the typical chokes found in the usual fluorescent lamp circuits using 60 Hz AC sources. By way of specific example, a choke suitable for use at 20 kHz will weigh on the order of 4 or 5 ounces whereas the corresponding choke for use at 60 Hz will weigh 4 or 5 pounds.

A significant feature of the invention is the selectively variable control over lamp intensity which potentiometer 23 provides. The power input to the lamp (and the resultant lamp intensity) are approximately proportional to the average magnitude of the lamp current, which is plotted in FIG. 2A. This plot shows the current reversal during periods when the transistor is turned off, which occurs, for example, at time $T_B$.

Assume that at a particular setting "X" of the potentiometer 23 in FIG. 1, the voltage on conductor 22 in FIG. 1 is lower than the voltage on the conductor at another setting "Y" of the potentiometer 23. The corresponding changes in the waveforms in FIGS. 2A, 2B, 2C, and 2D between the two settings of the variable resistor for effecting different levels of the lamp intensity are illustrated in these figures. In each figure, the waveform on the left represents setting X and the waveform on the right in each figure represents setting Y.

The manner in which this control is achieved with potentiometer 23 is as follows.

The peak lamp current always occurs whenever the transistor is turned off, corresponding to times $T_O$ and $T_B$. This occurs whenever the sum of the choke current and lamp current passing through the resistor, denoted 15 in FIG. 1, causes a voltage drop across this resistor equal to the voltage on the conductor, denoted 22 in FIG. 1. As stated above, this occurrence causes the comparator amplifier, 20 in FIG. 1, to give a positive output to the multivibrator, which in turn causes the multivibrator to turn the transistor off.

The current passing through the resistor, 15 in FIG. 1, is the collector current of the transistor. This current is plotted in FIG. 2C, as the sum of the lamp current and choke current in region B.

The peak collector current level is equal to the voltage on the conductor 22 in FIG. 1 divided by the resistance of the resistor, 15 in FIG. 1. When the voltage on the conductor 22 is increased or decreased, the collector current peak level iwll increase or decrease, respectively. Because the decay time of the current between time $T_O$ and time $T_A$ is always the same, the minimum value of the collector current will also increase or decrease, respectively. Thus, the entire waveform of the collector current will be shifted either up or down, respectively, of which two exemplary waveforms are plotted for the two different potentiometer settings X and Y. The waveforms of the choke current and the lamp current will also be shifted up or down, respectively, as shown. This effect is the result of the fact that the collector current through the transistor is the sum of the choke current and lamp current, and the fact that the lamp current is proportional to the choke current.

Thus, it may be seen that the lamp intensity, which is proportional to lamp circuit, is proportional to the voltage on the conductor 22. By changing the resistance of the potentiometer 23 in FIG. 1, the current supplied to the lamp 11 will change.

The useful life of the gas discharge lamp is increased in this invention since the net DC component of current through the lamp during continued operation is approximately zero. This is achieved by virtue of the parallel inductance which has the property of maintaining a zero DC voltage drop across its terminals. Since this zero DC voltage is also maintained across the lamp, the DC current through the lamp will also be zero.

Although the circuit is particularly suited for use with low intensity, low pressure mercury vapor fluorescent lamps, it can equally well be used to control various other types of gas discharge lamps such as high pressure mercury vapor, high or low pressure sodium, and metal Halide lamps.

FIG. 3 illustrates a modified embodiment of the invention in which a gas discharge lamp 35, typically a low pressure mercury vapor fluorescent lamp of approximately 22 watts, is provided. The electrodes 38 and 40 are of the heated type. Power is derived from a DC voltage source 16.

An inductor 37 is connected in series with the transistor 14 and resistor 15 across the power supply 36. The electrodes 38 and 40 of lamp 35 are tapped into sections 41 and 42 of the winding of inductor 37 to preheat such electrodes prior to ignition of the lamp.

The inductor 37 also acts as the primary winding of a transformer and has an iron core 39 and a step-down secondary winding 43 associated therewith. The winding 43 is connected in circuit with a diode 44 across a capacitor 45. The diode 44 is also connected through line 46 to the power input terminals of the comparator amplifier 20 and multivibrator 18. It is also used to supply the reference voltage to the potentiometer 23.

The sections 41 and 42 of the winding of inductor 37 enable the electrodes 38 and 40 to become heated before the lamp is ignited. This arrangement maximizes electrode life and prevents damage to the electrodes 38 and 40 due to the otherwise excessive rise of temperature at the start of a lamp operation.

The polarity of the winding 43 is preferably such that the capacitor 45 is charged only when the transistor 14 is conducting. This arrangement insures that the particular voltage on capacitor 45 is independent of the variable fly back voltage developed by the inductor 37 when the transistor 14 is cut off.

Figure 4:
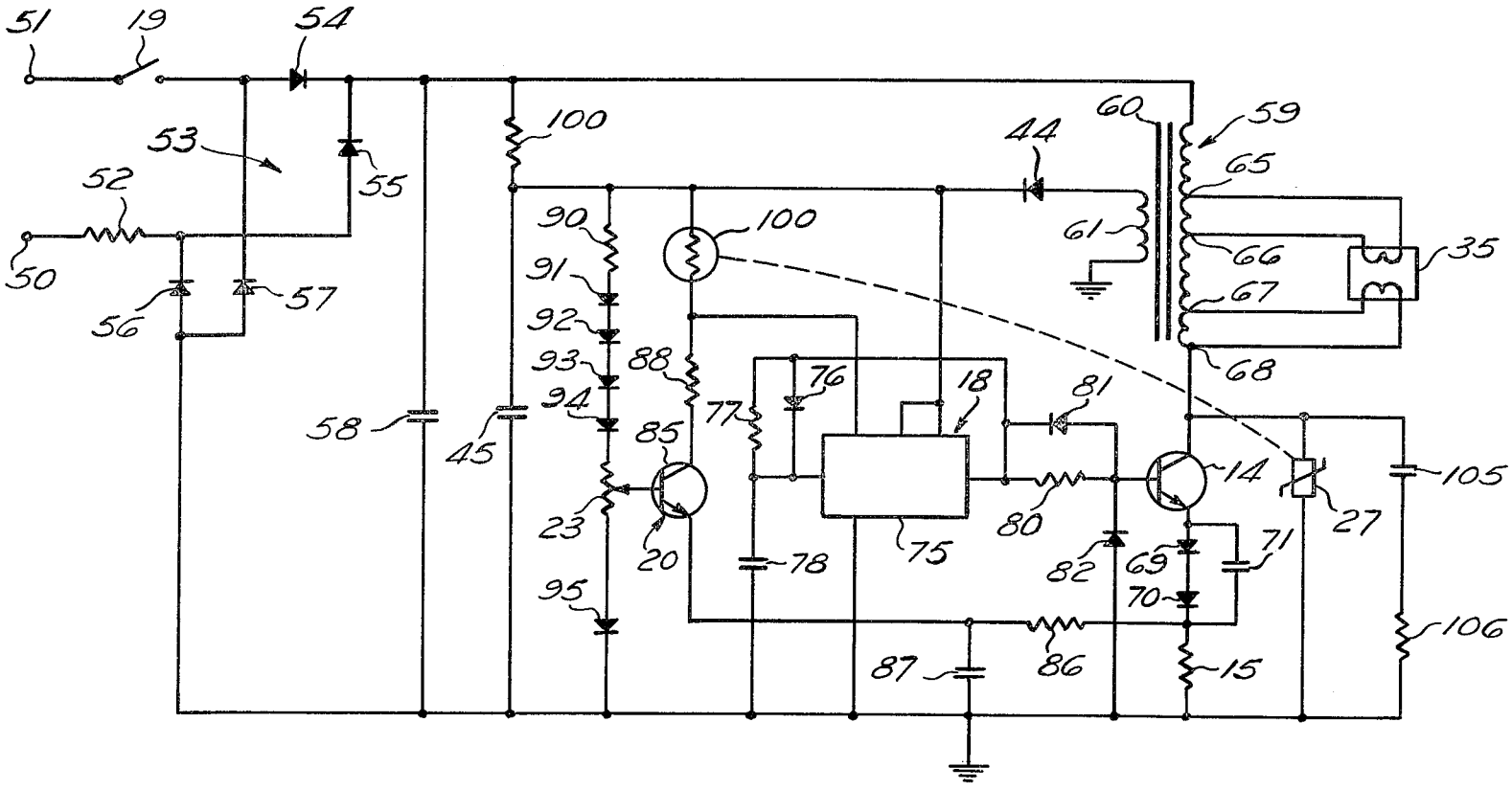
FIG. 4 illustrates a detailed circuit schematic including provision for (a) a step-down voltage supply to the lamp for matching the line voltage to the optimal lamps operating voltage and (b) a thermistor connected between the two inputs to the differential amplifier for sensing the temperature of the varistor device and protecting the varistor and transistor from destructive effects of transient power surges in the circuit.

FIG. 4 illustrates a detailed circuit schematic showing a number of circuit elements which were deleted from the simplified circuits described above to facilitate understanding of the overall operation of the invention. In addition, this figure illustrates several significant additional features of the invention.

The circuit of FIG. 4 is designed to operate from a standard 120-volt AC line connected to terminals 50 and 51. These terminals respectively connect to on-off switch 19 and current limiting resistor 52 to a full-wave diode bridge rectifier 53 comprising diodes 54, 55, 56, and 57. The DC output of this rectifier is connected across a wave smoothing capacitor 58. The negative bridge terminal is connected to ground and the positive bridge terminal is connected to one end of an auto-transformer winding 59 having a magnetic core 60, and secondary winding 61.

In the illustration, winding 59 functions as a voltage reducing auto-transformer with one of the lamp electrodes connected to respective mid-taps 65 and 66 and the other lamp electrode connected to taps 67 and 68 located at the end of the winding. The purpose of the auto transformer is to match the DC power supply with the optimum voltage characteristic of the lamp. For example, the output of the diode bridge 53 is approximately 168 volts DC with 120-volt AC input. The optimum voltage for a 22-watt fluorescent lamp is, however, typically only 55 volts. Accordingly, the auto-transformer winding is selected so that the step-down turns ratio is 168 divided by 55. It will be understood that if the optimum lamp operating voltage is larger than the DC power source voltage, a step-up auto-transformer would advantageously be used to supply the stepped up voltage in the same manner.

The collector of NPN switch transistor 14 is connected to the end terminal 68 of the auto-transformer winding 59. Its emitter is connected through a pair of diodes 69 and 70 and resistor 15 to ground. A capacitor 71 parallels the series connected diodes 69 and 70. Capacitor 71 is charged during steady state operation such that the combination of the capacitor 71 and diodes 69 and 70 back bias the transistor emitter.

Integrated circuit 75, diode 76, resistor 77, and capacitor 78 comprise one-shot multivibrator 18. The power supply for this one-shot multivibrator is provided by the secondary winding 61, diode 44, and capacitor 45 as described above with reference to the circuit of FIG. 3.

The base of transistor switch 14 is connected to the output of the one-shot multivibrator 18 through parallel connected resistor 80 and diode 81. Resistor 80 serves as a base current limiting resistor and shunting diode 81 serves to short out this resistor and provide a low impedance path for the charge stored in transistor 14 when the transistor is turned off. The base is also connected to ground through diode 82.

Comparator amplifier 20 comprises transistor 85 whose emitter is connected to the junction of diode 70 and resistor 15 through an RC filter comprising resistor 86 and capacitor 87. Its base is connected to potentiometer 23 and its collector is connected to the input of one-shot multivibrator 18 through resistor 88.

Potentiometer 23 is connected in series circuit with the resistor 90 and diodes 91, 92, 93, 94, and 95. Resistor 90 reduces the sensitivity of potentiometer 23. Diodes 91 through 94 protect the circuit against transients when the on-off switch 19 is initially closed and diode 95 compensates for the base-emitter drop of comparator transistor 20. As in the embodiment of FIG. 3, the reference voltage for potentiometer 23 is provided by the output of secondary winding 61. The RC filter comprising resistor 86 and capacitor 87 serves to prevent a voltage or current transient from affecting comparator transistor 20 and inadvertently triggering the one-shot multivibrator 18.

A resistive path directly connecting the positive terminal of the diode bridge 53 to the power supply provided by secondary winding 61 is provided by resistor 100. This resistor serves as a current bleeder resistor to provide start-up power when the on-off switch 19 is initially closed.

Capacitor 105 and resistor 106 function in parallel with varistor 27 as a snubber protective circuit for protecting the transistor 14 from the inductive auto-transformer load when the transistor is being turned off.

Another significant feature of the circuit of FIG. 4 is the inclusion of thermistor 110 electrically connected between the input of one-shot multivibrator 18 and the positive side of the power supply capacitor 45. The thermistor is mechanically and thermally attached to the varistor 27 as indicated by the dotted line. The varistor has a negative temperature coefficient selected such that when a transient surge in the circuit causes the varistor to begin to overheat, the thermistor will become highly conductive and act to hold the input of the one-shot multivibrator high, thereby maintaining the transistor 14 in the off state. Thus, the circuit illustrated in FIG. 4 will remain effectively shut down until such time as the varistor 27 has a chance to cool. Accordingly, it will be seen that thermistor 48 prevents overheating of the varistor 27.

An exemplary circuit for operation of a 22-watt fluorescent lamp from 120-volt AC power constructed in accordance with FIG. 6 included the following circuit components:

| | |
|---|---|
| Transistor 14 | MJE 13004 (Motorola) |
| Resistor 15 | 2.2 ohm |
| Potentiometer 23 | 200 ohm |
| Varistor 27 | V275LA 20 (General Electric) |
| Resistor 52 | 1.5 ohm |
| Diodes 54–57 | IN4003 |
| Capacitor 58 | 100 Micro farad |
| Winding 59 | 263 + 6 + 150 + 6 turns |
| Core 60 | Ferroxcube 376U250-3c8 and 376B250-3c8 |
| Winding 61 | 41 Turns |
| Diodes 69, 70, 76, 81, 82, 91–95 | IN4148 |
| Capacitor 71 | 10 Micro farad |
| Integrated Circuit 75 | NE 555 V |
| Resistor 77 | 10K ohm |
| Capacitor 78 | .0033 Micro farad |
| Resistor 80 | 200 ohm |
| Transistor 85 | 2N 3904 |
| Resistor 86 | 22 ohm |
| Capacitor 87 | .1 Micro farad |
| Resistor 90 | 1.3K ohm |
| Resistor 100 | 20K ohm |
| Capacitor 105 | 560 Pico farad |
| Resistor 106 | 220 ohm |
| Thermistor 110 | 4C5002 (Western Thermistor) |

The circuit of FIG. 4 may be used in those circumstances wherein the power factor of the entire lamp circuit is not critical. Thus, it will be understood by those skilled in the art that the wave smoothing capacitor 58, connected across the full-wave rectifier bridge 53, while being used to provide essentially a DC signal level to the circuit, nevertheless reduces the power factor of the circuit substantially. This is a result of the phase difference between the current and voltage at the terminals 50,51 caused by the impedance of capacitor 58. Such a power factor reduction is not permissible under certain circumstances.

Figure 6A:
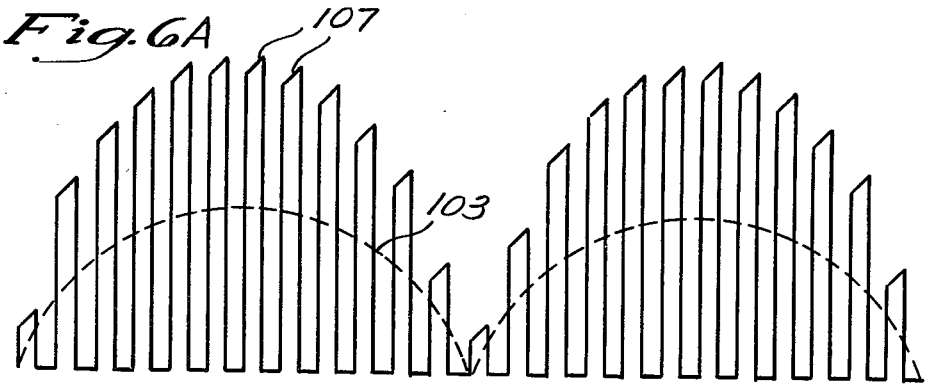
FIG. 6A is a plot of the current drawn by the lamp circuit from the full-wave rectifier showing both the instantaneous current levels and the average current level.
Figure 6B:
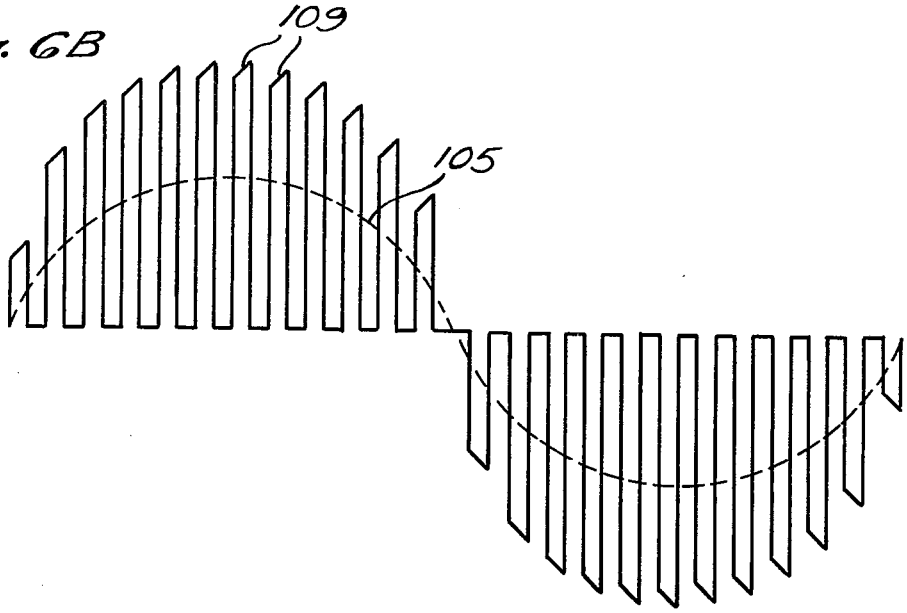
FIG. 6B is a plot of the current, both instantaneous and average, drawn by the full-wave rectifier from the power line.

The embodiment of FIG. 5 provides a solution to this power factor problem in which the circuit still operates from a 60 -cycle alternating current source, but in this instance, the power factor is near unity. This is accomplished by connecting the potentiometer 23 which provides the reference signal level for the comparator 20 through a resistor 101 to the rectified AC voltage from the diode bridge 53. Thus, the circuit of FIG. 5 is similar in operation to that of FIG. 4, except that the reference voltage for the comparator/amplifier 20 is derived through the potentiometer 23 from a varying AC voltage rather than a fixed DC level, as was the case in FIG. 4. This varying reference level provides, in accordance with the waveforms of FIG. 2, a varying transistor switch current (FIG. 2C) which is programmed, or fluctuates, in accordance with the 60 Hz input AC signal level. This fluctuation is shown in FIG. 6A and the resulting line current drawn at the bridge 53 is as shown in FIG. 6B, that is, the unrectified equivalent of FIG. 6A. It will be seen from FIGS. 6A and 6B that the comparator 20 has been provided with a fluctuating threshold voltage which forces the current level through the resistor 15 to cyclically vary in a cycle which is precisely in phase with the applied voltage from the 60-cycle source. In each of FIGS. 6A and 6B, the average current 103 and 105, respectively, is shown for the resistor 15 and the input power terminals 50 and 51. This average current 103,105 is precisely in phase with the applied voltage, since the individual 20–40 kiloHertz peaks 107 and 109, respectively, of FIGS. 6A and 6B, have been programmed to be proportional to the applied voltage.

Since the average current 105 is in phase with the applied voltage, the power factor of the circuit of FIG. 5 is essentially unity. Thus, it has been found that, by using the circuit of FIG. 5, the large wave smoothing capacitor 58 of FIG. 4 may be eliminated from the circuit and the threshold voltage of the comparator 20 may be made to follow the 60-cycle AC line voltage by connecting the potentiometer 23 through a resistor 101 to the input rectified line source.

The arrangement described improves the power factor of this lamp circuit so that it may be applied in most circumstances to standard AC line sources. It does, however, produce an additional problem not present in the circuit of FIG. 4. Specifically, it has been found that the resistance of the lamp 35 becomes very high each time that the applied AC line voltage at terminals 50, 51 crosses zero volts.

The relatively high resistance of the lamp 35 which is experienced at each zero crossing of the line voltage may be explained as follows. A gas discharge lamp 35 may be characterized as a resistor for frequencies whose period is small compared to the ionization time constant of the lamp. This is true for the ballast oscillation frequency of 20–40 kHz but not for the power line frequency 60 Hz. Thus, the ionization time constant of a 22-watt Circline fluorescent lamp, for example, is 0.4 milliseconds. Consequently, the effective resistance of the lamp will vary during the 60-Hz line cycle. This resistance is greatest right after a zero axis crossing and decreases as the cycle progresses, reaching a minimum value approximately 60 electrical degrees before the next zero axis crossing.

This high resistance of the lamp 35 causes the frequency of oscillation of the ballast circuit to decrease. Thus, while the normal frequency of oscillation is chosen to be above the audible range, the frequency may periodically drop down into the audible range after each line voltage zero axis crossing, which may prove annoying to persons near the lamp. In addition, and of more importance, is the fact that, after each zero axis crossing of the AC line voltage, an extremely high voltage will appear at the collector of the transistor 14, when the transistor 14 turns off. As was explained previously, if the lamp 35 is removed from the circuit, the collector of the transistor 14 is subjected to the extremely high fly back voltage of the ballast 17. This same affect occurs after each zero crossing of the applied line voltage, since the effective resistance of the lamp 35 is very high. The repetitively applied high voltage at the collector of the transistor 14 may damage the transistor 14. Even if a protective clamping device is employed, this device may itself overheat.

The circuit of FIG. 7 provides a solution to this resistance problem without substantially degrading the circuit's power factor. The circuit of FIG. 7 is substantially identical to that of FIG. 4, except that it incorporates the 60 Hz input to the comparator/amplifier 20 described in reference to FIG. 5. In addition, a second secondary winding 107 has been added to the core 60, this winding being connected to a series combination of a diode 109 and capacitor 111. In addition, the junction between the diode 109 and the capacitor 111 is connected by a diode 113 to the output line 115 from the bridge 53. In addition, a filter circuit in the form of a series inductance 117 and shunt capacitor 119 is added between the line input terminals 50,51 of the full-wave rectifying bridge 53.

The capacitor 111 is relatively large, having enough capacity to support the power drain of the ballast 59 during zero axis crossing of the AC power line voltage at terminals 50,51. The turns ratio of the transformer 107 is preferably less than one so that the voltage of the capacitor 111 is maintained at a lower value than the peak value of the line voltage on line 115.

This circuit operates as follows. The transformer 107, capacitor 111, and the diode 109 form a positive DC power supply, charged periodically by the rectified voltage on line 115. This DC power supply is only connected to supply power to the winding 59 when the AC line voltage on line 115 drops below the voltage to which their capacitor 111 is charged. At this time, the capacitor 111 supplies current through the diode 113 to the ballast circuit 59. The diode bridge 53, during this same time period, disconnects the ballast 59 from the AC power lines, since the diodes 51–57 within the bridge 53 are reversed biased. Thus, the line current drops to zero.

The capacitor 111 continues to supply the ballast current until that point in the next half cycle when the line voltage on line 115 reaches the voltage level of the capacitor 111. At this time, the diode 113 becomes reversed biased, and the AC power line 115 supplies power to the ballast 59.

The inductor 117 and capacitor 119 may be selected to filter out the 20–40 kHz variations of FIG. 6B without substantially effecting the 60-Hz power factor.

Figure 8A:
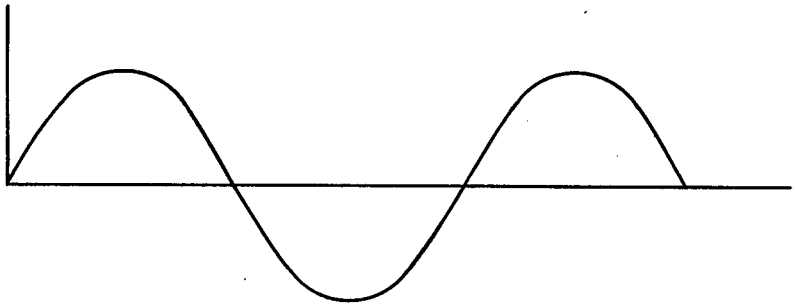
FIG. 8A is a plot of the line voltage supplied to that circuit.
Figure 8B:
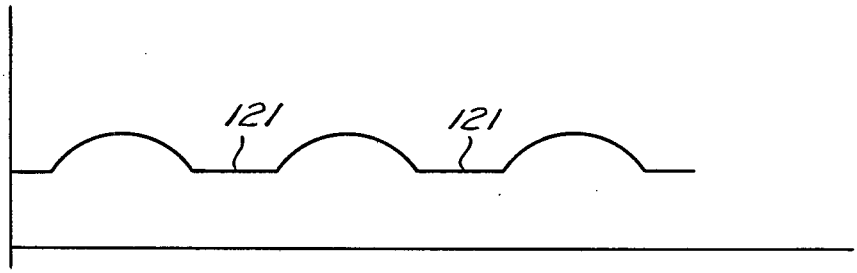
FIG. 8B is a plot of the voltage at the output of the rectifying bridge and FIG. 8C is a plot of the current drawn from the power lines by the circuit of FIG. 7.
Figure 8C:
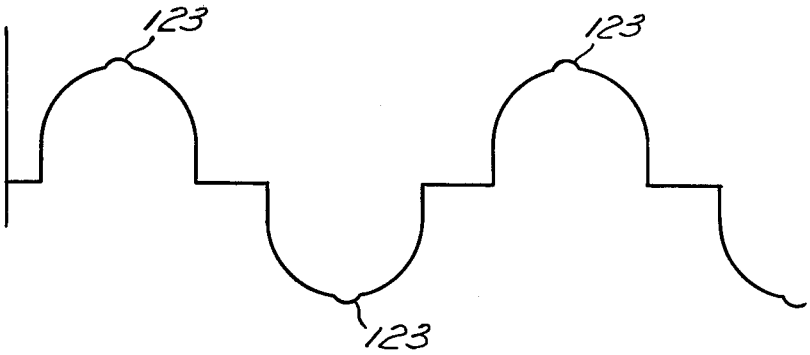

Waveforms for the circuit of FIG. 7 are shown in FIGS. 8A, 8B, and 8C, wherein FIG. 8A is the applied AC line voltage at terminals 50 and 51, showing the location of the zero crossing point, FIG. 8B is the voltage at line 115 of FIG. 8 showing that the voltage is the rectified equivalent of the voltage of FIG. 8A, except that the voltage is held up or supported at a level 121 by the capacitor 111 at each zero crossing location. This, of course, prohibits a nulling at the ballast 59 so that the lamp resistance of the lamp 35 never increases to a level which would generate excessive voltages at the transistor 14. Likewise, the voltage is maintained at a level which prohibits the lamp resistance 35 from lowering the frequency of the ballast circuit into the audible range.

FIG. 8C shows the line current drawn by the entire circuit at the AC line junctions 50 and 51. This current is filtered by the inductor 117 and capacitor 119 so that only the low frequency components remain. From FIG. 8C, it can be seen that no current is drawn during those periods of time when the capacitor 111 supports the ballast current. In addition, FIG. 8C shows small current pulses 123 which occur at the peaks of the AC line voltage and reflect the additional current utilized in charging the capacitor 111 at this time when the output of the transformer 107 exceeds the voltage of the capacitor 111.

While it can be seen that the current waveform of FIG. 8C is not a perfect sinusoid, it nevertheless is in phase with the voltage waveform of 8A and is sufficiently smooth and uniform so that the power factor is still near unity. The circuit of FIG. 7 thus provides a high power factor lamp circuit which utilizes a small ballast and provides for a programmed current level for the lamp wherein each current peak at the 20–40 kHz rate is programmed to reach a level which is in a predetermined proportion determined by the potentiometer 23 and resistor 88 of the line voltage. At the same time, excessive voltages on the switching capacitor and reductions in the frequency of the entire circuit are eliminated through the use of the capacitor 111 which supports the line voltage level to prohibit a nulling of the rectified voltage.

We claim:

1. A circuit for energizing a gas discharge lamp comprising:

first means for storing magnetic energy connected in parallel combination with the electrodes of the gas discharge lamp;

second means for connecting a rectified AC power supply to said parallel combination;

third means operatively coupled to said second means for interrupting the connection between said power supply and said parallel combination for a predetermined length of time, shorter than the period of said AC power supply, whenever the current through said parallel combination has increased to a predetermined level; and fourth means for programming said predetermined level to vary in accordance with the varying AC voltage of said rectified AC power supply.

2. A circuit for energizing a gas discharge lamp as defined in claim 1 wherein said fourth means programs said predetermined level at a predetermined ratio of said power supply voltage.

3. The circuit of claim 2 additionally comprising:

fifth means for varying said predetermined ratio.

4. The circuit of claim 3 wherein said fifth means comprises a potentiometer connected to said power supply voltage and said third means.

5. Apparatus for energizing a gas discharge lamp having a pair of electrodes which comprises:

a rectified AC voltage supply circuit;

a switching device;

a resistor;

means connecting said electrodes, said switching device and said resistor in series across said supply circuit;

an inductor connected in parallel with said electrodes;

a one-shot multivibrator having a first fixed time output state and a second variable time output state;

means connecting the output of said multivibrator to said switching device to close said switching device during said first output state and to open said switching device during said second output state; and means responsive to a rise in voltage across said resistor and to the output of said rectified AC voltage supply for triggering said multivibrator to said second state to vary the peak current through said inductor and said lamp in accordance with the varying AC voltage of said AC voltage supply.

6. Apparatus as defined in claim 5 wherein said lamp has a predetermined ionization time period and wherein the time period of said first state is less than said ionization time period.

7. Apparatus as defined in claim 5 wherein said triggering means comprises:

means for comparing said rise in voltage and said rectified AC voltage supply output and for triggering said one-shot multivibrator to said first state when said rise in voltage reaches a predetermined fraction of said voltage supply output.

8. Apparatus as defined in claim 7 additionally comprising:

means for variably adjusting said predetermined fraction.

9. Apparatus as defined in claim 8 wherein said variable adjustable means comprises a potentiometer.

10. Apparatus as defined in claim 5, additionally comprising:

means prohibiting said rectified AC voltage supply circuit from reaching a null.

11. Apparatus as defined in claim 10 wherein said prohibiting means comprises:

a capacitor connector to provide current to said electrodes when the voltage of said capacitor exceeds the voltage of said AC voltage supply circuit.

12. Apparatus as defined in claim 11 additionally comprising:

means charging said capacitor from said AC voltage supply circuit.

13. Apparatus for energizing a gas discharge lamp from an AC power source, comprising:

an inductor connected in parallel with said lamp;

means for generating an alternating current signal having a frequency substantially higher than the frequency of said AC power source and a fixed time period during one half cycle;

means for modulating the peak level of said alternating current signal to provide a current waveform which varies at said higher frequency and maintains said fixed time period half cycle, but which has an average current which varies at said power source frequency; and means for energizing said lamp and said inductor with said alternating current signal.

14. Apparatus for energizing a gas discharge lamp as defined in claim 13, additionally comprising:

a filter connected to said means for generating an alternating current signal, said filter removing components of said alternating current signal having a frequency substantially higher than the frequency of said AC power source.

15. Apparatus for energizing a gas discharge lamp as defined in claim 13, additionally comprising:

means connected to said AC power source for supplying power to said generating means, said power supply means rectifying current from said AC power source and providing a minimum voltage level to said means for generating an alternating current signal whereby the null voltage usually resulting from rectifying an AC power source is avoided.

16. Apparatus for energizing a gas discharge lamp as defined in claim 13, wherein said average current is in phase with the voltage of said AC power source.

17. A circuit as defined in claim 1, additionally comprising:

means responsive to the voltage of said AC power supply for operating exclusively near the zero crossing point thereof to supply current to said lamp, comprising:

means for storing energy;

means for supplying energy to said energy storing means from said AC power supply at a voltage reduced from the voltage of said AC power supply; and means for connecting said energy storing means to said lamp, exclusively near said zero crossing.

18. A circuit as defined in claim 1, additionally comprising:

means responsive to the voltage of said AC power supply for operating exclusively near the zero crossing point thereof to supply current to said lamp, comprising:

means for storing energy; and a diode connected between said energy storing means and said lamp, said diode connecting said energy storing means to said lamp exclusively near said zero crossing point.

* * * * *